US008091265B1

(12) United States Patent
Teetzel et al.

(10) Patent No.: US 8,091,265 B1
(45) Date of Patent: Jan. 10, 2012

(54) FLOATING RAIL SYSTEM FOR FIREARM

(75) Inventors: James W. Teetzel, York, ME (US); Jesse T. Bodwell, Manchester, NH (US)

(73) Assignee: Wilcox Industries Corp., Newington, NH (US)

( * ) Notice: Subject to any disclaimer, the term of this patent is extended or adjusted under 35 U.S.C. 154(b) by 878 days.

(21) Appl. No.: 11/972,426

(22) Filed: Jan. 10, 2008

Related U.S. Application Data

(60) Provisional application No. 60/879,777, filed on Jan. 10, 2007, provisional application No. 60/879,897, filed on Jan. 11, 2007, provisional application No. 60/920,106, filed on Mar. 26, 2007.

(51) Int. Cl.
*F41C 23/00* (2006.01)

(52) U.S. Cl. ..... 42/72; 42/71.01; 42/124

(58) Field of Classification Search ..... 42/72, 71.01, 42/124

See application file for complete search history.

(56) References Cited

U.S. PATENT DOCUMENTS

| | | | | |
|---|---|---|---|---|
| 5,033,219 | A * | 7/1991 | Johnson et al. | 42/115 |
| 5,826,363 | A * | 10/1998 | Olson | 42/75.01 |
| 6,499,245 | B1 * | 12/2002 | Swan | 42/71.01 |
| 6,508,027 | B1 * | 1/2003 | Kim | 42/124 |
| 6,618,976 | B1 * | 9/2003 | Swan | 42/114 |
| 6,779,288 | B1 * | 8/2004 | Kim | 42/72 |
| 6,792,711 | B2 * | 9/2004 | Battaglia | 42/114 |
| 6,854,206 | B2 * | 2/2005 | Oz | 42/124 |
| 6,895,708 | B2 * | 5/2005 | Kim et al. | 42/72 |
| 7,059,076 | B2 * | 6/2006 | Stoner et al. | 42/75.01 |
| 7,188,978 | B2 * | 3/2007 | Sharrah et al. | 362/396 |
| 7,216,451 | B1 * | 5/2007 | Troy | 42/72 |
| D556,289 | S * | 11/2007 | Yu | D22/108 |
| RE40,216 | E * | 4/2008 | Swan | 42/71.01 |
| 7,363,741 | B2 * | 4/2008 | DeSomma et al. | 42/85 |
| 7,458,179 | B2 * | 12/2008 | Swan | 42/72 |
| 7,523,580 | B1 * | 4/2009 | Tankersley | 42/71.01 |
| 7,676,975 | B2 * | 3/2010 | Phillips et al. | 42/72 |
| D616,521 | S * | 5/2010 | Starnes | D22/108 |
| 7,707,762 | B1 * | 5/2010 | Swan | 42/85 |
| 7,793,452 | B1 * | 9/2010 | Samson et al. | 42/72 |
| 2003/0074822 | A1 * | 4/2003 | Faifer | 42/71.01 |
| 2003/0106251 | A1 * | 6/2003 | Kim | 42/71.01 |
| 2005/0000142 | A1 * | 1/2005 | Kim et al. | 42/124 |
| 2005/0217161 | A1 * | 10/2005 | Haugen et al. | 42/124 |
| 2005/0241211 | A1 * | 11/2005 | Swan | 42/124 |
| 2006/0010748 | A1 * | 1/2006 | Stoner et al. | 42/71.01 |
| 2007/0006509 | A1 * | 1/2007 | DeSomma et al. | 42/72 |
| 2008/0092422 | A1 * | 4/2008 | Daniel et al. | 42/90 |
| 2008/0216380 | A1 * | 9/2008 | Teetzel | 42/127 |
| 2008/0301994 | A1 * | 12/2008 | Langevin et al. | 42/71.01 |
| 2010/0122485 | A1 * | 5/2010 | Kincel | 42/146 |
| 2010/0126054 | A1 * | 5/2010 | Daniel et al. | 42/71.01 |
| 2010/0154280 | A1 * | 6/2010 | LaFrance et al. | 42/124 |

(Continued)

*Primary Examiner* — Michelle Clement
(74) *Attorney, Agent, or Firm* — McLane, Graf, Raulerson & Middleton, Professional Association

(57) ABSTRACT

An improved floating rail system for mounting accessories on a firearm having a barrel including a chassis and a clamp adapted to attach the chassis about the barrel of the firearm. A plurality of elongate accessory mounting rails are attached to the chassis and extend parallel to an axis of the barrel. The accessory mounting rails are supported in the chassis radially spread apart from the barrel.

20 Claims, 13 Drawing Sheets

U.S. PATENT DOCUMENTS

2010/0175293 A1* 7/2010 Hines ..... 42/71.01
2010/0186278 A1* 7/2010 Daniel ..... 42/71.01
2010/0192443 A1* 8/2010 Cabahug et al. ..... 42/71.02
2010/0192444 A1* 8/2010 Cabahug et al. ..... 42/71.02
2010/0218410 A1* 9/2010 Cabahug et al. ..... 42/71.01
2010/0229448 A1* 9/2010 Houde-Walter et al. ..... 42/72

* cited by examiner

FLOATING RAIL SYSTEM FOR FIREARM

RELATED APPLICATIONS

This application claims the priority benefit under 35 U.S.C. §119(e) of U.S. provisional patent application Nos. 60/920,106 filed Mar. 26, 2007; 60/879,777 filed Jan. 10, 2007; and 60/879,897 filed Jan. 11, 2007. Each of the aforementioned applications is herein incorporated by reference in its entirety.

BACKGROUND

The present disclosure relates to a floating rail system providing a weapon accessory mount interface, including mounting rail structure such as a "Picatinny" interface (e.g., as per standard MIL-STD-1913) for use with a firearm. The system in accordance with this disclosure may be used for attaching a thermal sight system, rotating left/right camera system, video display system, quick changing power supplies, optical scopes, tactical flashlights, vertically extending handgrips, or other weapon-mounted accessories.

Conventional Picatinny rails require multiple clamps to attach to a firearm and lack attached power supplies. In addition even where power supplies are attached to the rail systems the rails do not contain circuits and conductors within the rail systems to provide power and to operate accessory devices. Thus, it would be desirable to provide a floating rail system with one clamping mechanism to the firearm which securely attaches the floating rail system and all attached devices to the firearm ensuring they are aligned with the barrel of the gun. In addition it would be desirable to have a power supply attached to the firearm to supply any necessary power to the attached accessory devices. Circuits and conductors built into the rail system are also desirable because it decreases the number of components required to run additional devices. The present device contemplates an improved floating rail system which overcomes the above-referenced limitations and others.

SUMMARY

An improved floating rail system is provided for a weapon which can accommodate multiple accessory devices and the power supply needed to operate them. Such accessory devices include laser and optical scopes, thermal sights, left and right rotating camera modules, a modular weapon video display system including a video control panel and a human-viewable display screen, handgrip units, and power supplies. The floating rail system is composed of a rear clamp and a top and bottom chassis, where the chasses connect and their exterior attaches to the interior of the rear clamp. The rear clamp enables the floating rail system to attach to the firearm and extend out over the firearm's barrel without making contact with it. Various fasteners and grips can be used to attach accessory devices to the floating rail system. Devices that require power supplies may contain contacts which enable them to create a circuit with the conductor on the modular rails or their fasteners or grips may contain the contacts. Once the device is secured to the modular rails it will have a power supply and be able to transmit signals to other devices attached to the modular rails. This improved floating rail system also contains rail insulators and an air gap between the chassis and the modular rails enabling the floating rail system to remain cooler to the touch due to the lengthened heating period thereby lessening the need for hand guards. Both the rail insulators and the air gaps allow the heat expelled from the barrel when the weapon is fired to be removed from the interior of the floating rail system without heating the exterior of the rail system.

One advantage of the floating rail system in accordance with the present disclosure resides in the circuitry which may be provided therewith, enabling power to pass to accessory devices from the power supply and enabling control signals to pass between various accessory devices. Such signals allow one accessory device to operate another without wires needing to travel between the two devices. For example a control signal actuator may be equipped with switches to send signals to control attached accessory devices.

Another advantage of the floating rail system in accordance with the present disclosure is its ability to prevent or reduce heating of the floating rail system when the weapon is fired. This increased heating time during firing lessens the need for hand guards as it takes more continuous rounds in a short period of time to heat the floating rail system.

Still further advantages and benefits of the present disclosure will become apparent to those of ordinary skill in the art upon reading and understanding the following detailed description of the preferred embodiments.

BRIEF DESCRIPTION OF THE DRAWINGS

The invention may take form in various components and arrangements of components, and in various steps and arrangements of steps. The drawings are only for purposes of illustrating preferred embodiments and are not to be construed as limiting the invention.

DETAILED DESCRIPTION OF THE PREFERRED EMBODIMENTS

Figure 1:
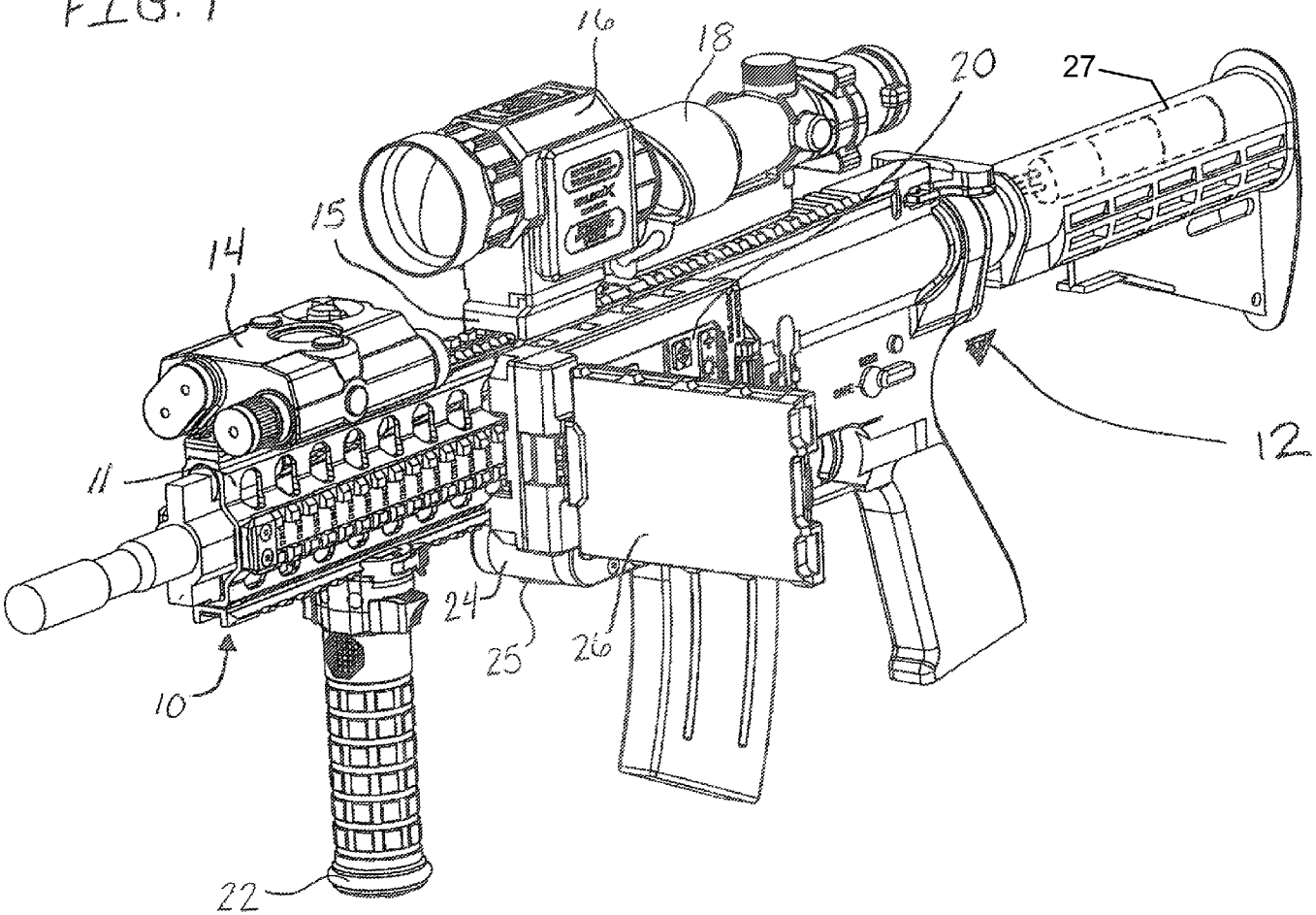
FIG. 1 is an isometric view of a firearm using a floating rail system with attached laser sight, optical scope, thermal sight, weapon video display, and vertical handgrip.

FIG. 1 illustrates an exemplary floating rail interface 10 attached to a firearm 12, such as a military or tactical weapon, with attached accessory devices. Such accessory devices include laser sight 14, thermal sight 16, optical scope 18, a modular weapon video display system including a video control panel 20 and a human-viewable display screen 26, handgrip unit 22, and power supply 24. Additional accessory devices can also be attached to the floating rail interface 10, such as a left and right rotating camera module.

One method of attachment of accessory devices to the floating rail system 10 is a three point fastener 15 as described in U.S. provisional patent application No. 60/855,928 filed Nov. 1, 2006, or U.S. patent application Ser. No. 11/933,887 filed on Nov. 1, 2007, which applications are herein incorporated by reference in their entireties. In this manner, the optical scope 18 may maintain its bore sight when removed temporarily from the rail interface, e.g., for hand held use.

Once the laser sight 14 is attached to the floating rail system 10 it may be controlled by controls located on handgrip unit 22. Handgrip unit 22 contains actuators for selectively actuating weapon-mounted accessories such as the laser sight 14, additional accessories include flashlights, fire control systems, communication devices, and laser designators. These accessory devices may be mounted on any of Picattiny rails 30*a*, 30*b*, 30*c*, and 30*d*, and still be controlled by handgrip unit 22. Handgrip unit 22 may be a bipod handgrip unit as described in U.S. patent application Ser. No. 11/651,743 filed Jan. 10, 2007, U.S. patent application Ser. No. 11/084,942 filed Mar. 21, 2005, or U.S. provisional application No. 60/555,279 filed Mar. 22, 2004. Each of the aforementioned applications is incorporated herein by reference in its entirety.

The video collected from the thermal sight 16 can be viewed using the weapon video display system composed of video control panel 20 and display screen 26. The images collected from thermal sight 16 are fed to the human-viewable display screen 26 and are viewable thereon. The video control panel 20 enables the user to change the settings of display screen 26. In addition the video control panel 20 enables the user to select which camera to view when multiple cameras are attached to the modular rails 30. A power supply 24 provides the power needed for the video control panel 20 and display screen 26 as well as the cameras and any other devices needing power that are attached to the modular rails 30. When the display screen 26 is not in use it can be folded flat to the video control panel 20 because the display screen 26 is hingedly or pivotally mounted to the video control panel 20.

Figure 2:
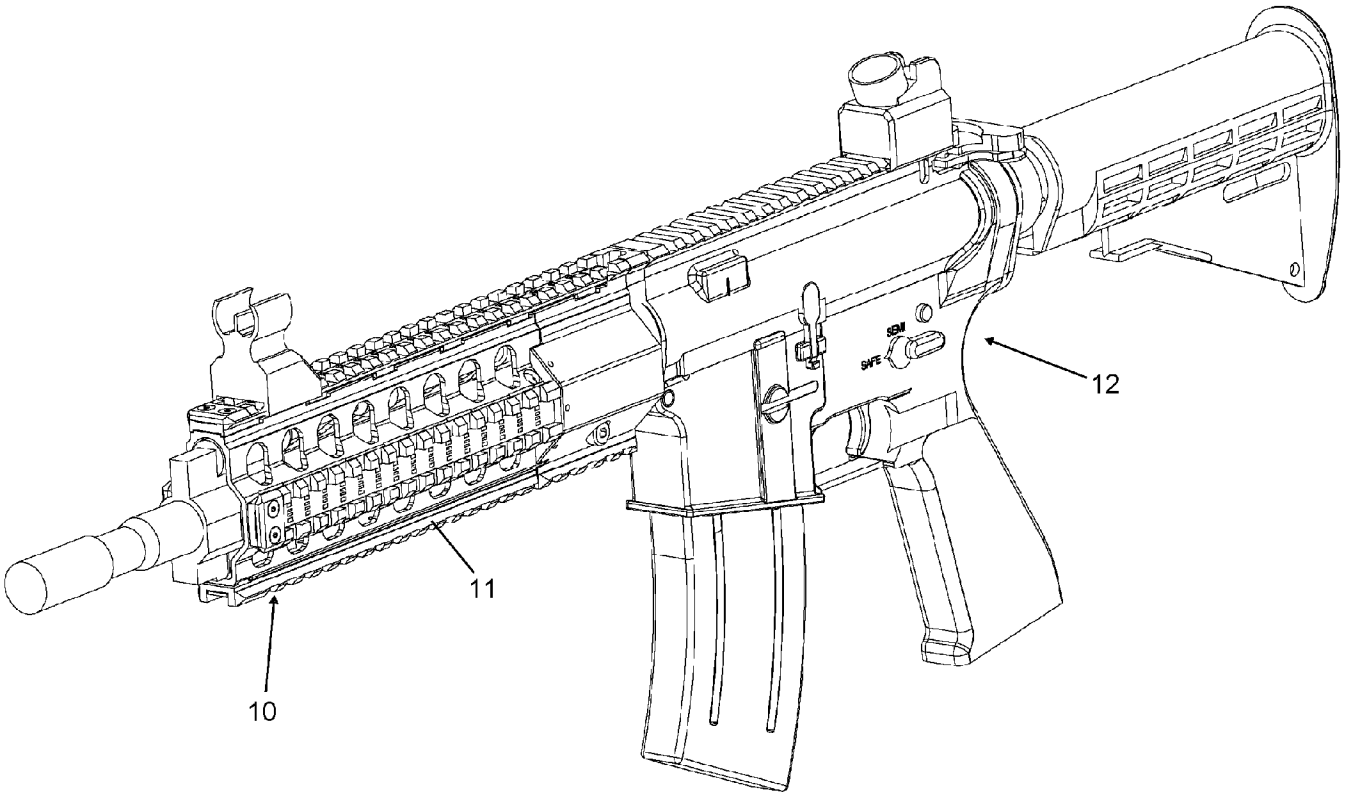
FIG. 2 is an isometric view of a firearm using a floating rail system.
Figure 3:
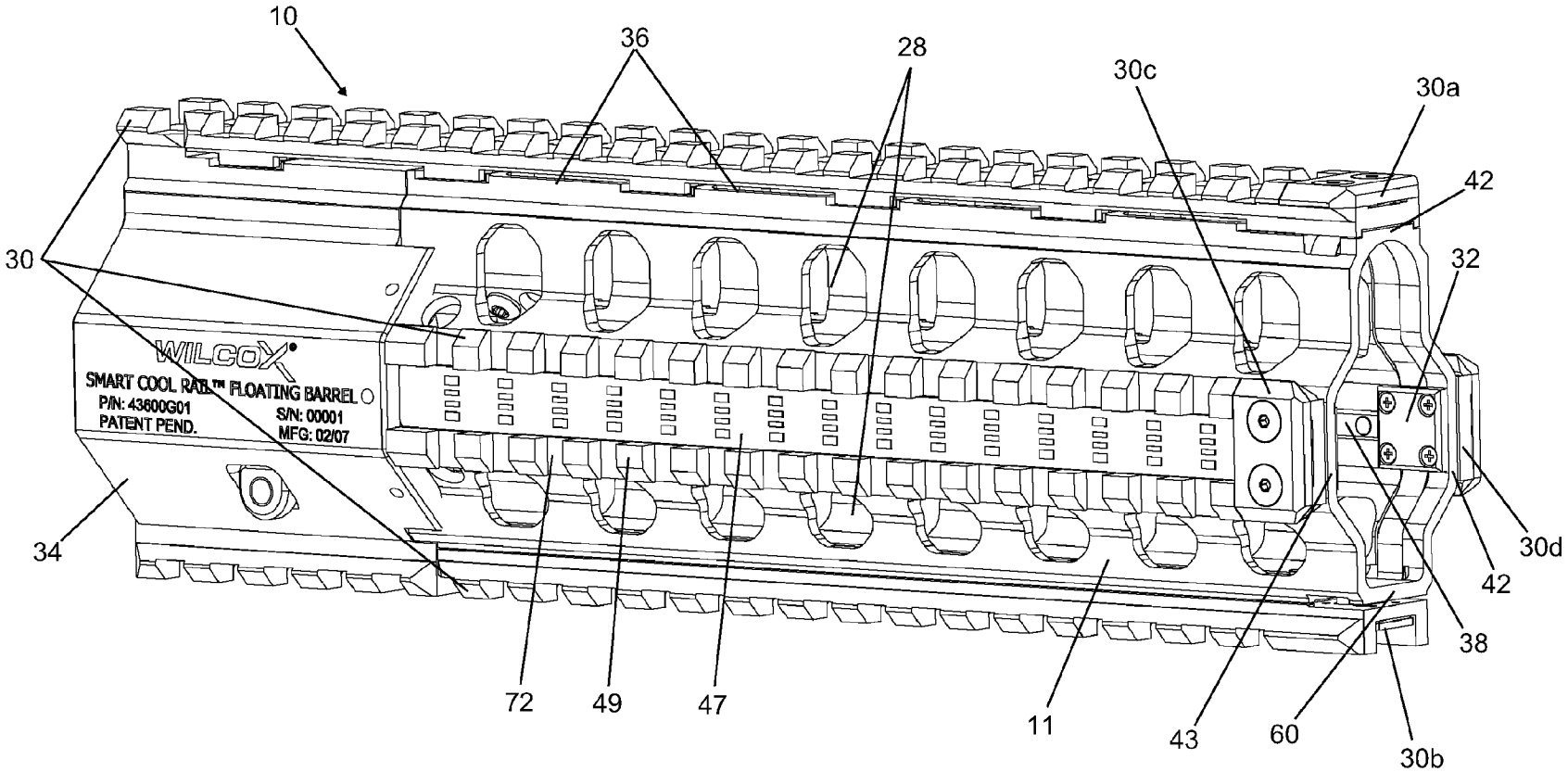
FIG. 3 is a side isometric view of the floating rail system.
Figure 4:
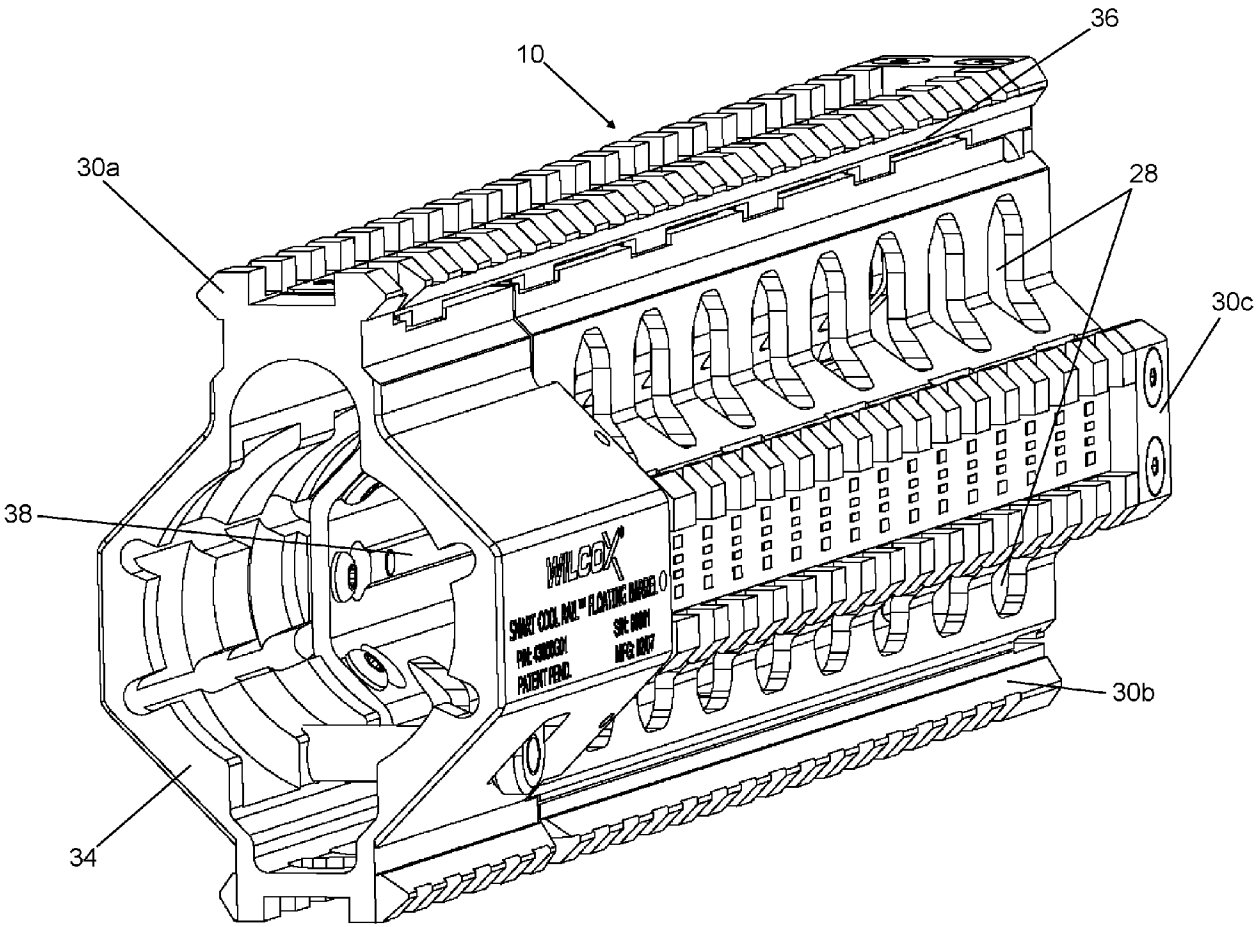
FIG. 4 is an isometric view of the floating rail system illustrating the floating rail interface.

FIG. 2 shows the attachment of the floating rail system 10 mounted to firearm 12 without any accessory devices attached. The floating rail system 10 is shown in FIGS. 3 and 4 and includes a chassis 11 having a top rail chassis portion 42, a bottom rail chassis portion 60, a left side rail chassis portion 43, and a right side rail chassis portion 41. The chassis 11 is secured about the fore-end portion of firearm 12 via a rear clamp 34 at the proximal end of the chassis 11. The distal end of chassis 11 is cantilevered out from the receiver portion of firearm 12 and does not contact the barrel. The modular Picatinny rails 30*a*, 30*b*, 30*c*, and 30*d* are secured to the top, bottom, left and right chassis portions, respectively. Rail air gaps 36 are created between the chassis portions and their respective modular Picatinny rails 30 allowing for air circulation in the interior compartment defined by the chassis 11.

Recesses 46 may be formed in the chassis 11 to reduce the weight of firearm 12 and provide a greater air gap, thereby increasing the thermal insulating properties of floating rail system 10. Axially extending conductors 38 enable power and control signals to pass from one circuit board 50 to the others to enable attached accessory devices to be powered and/or controlled. For example, the contacts 62 on the handgrip 22 are electrically coupled to one or more switches 23 on the handgrip unit 22 (See FIG. 12). The actuation of one or more switches 23 on the handgrip unit 22 outputs a control signal to the control signal conductors in the circuit board 50.

Figure 5:
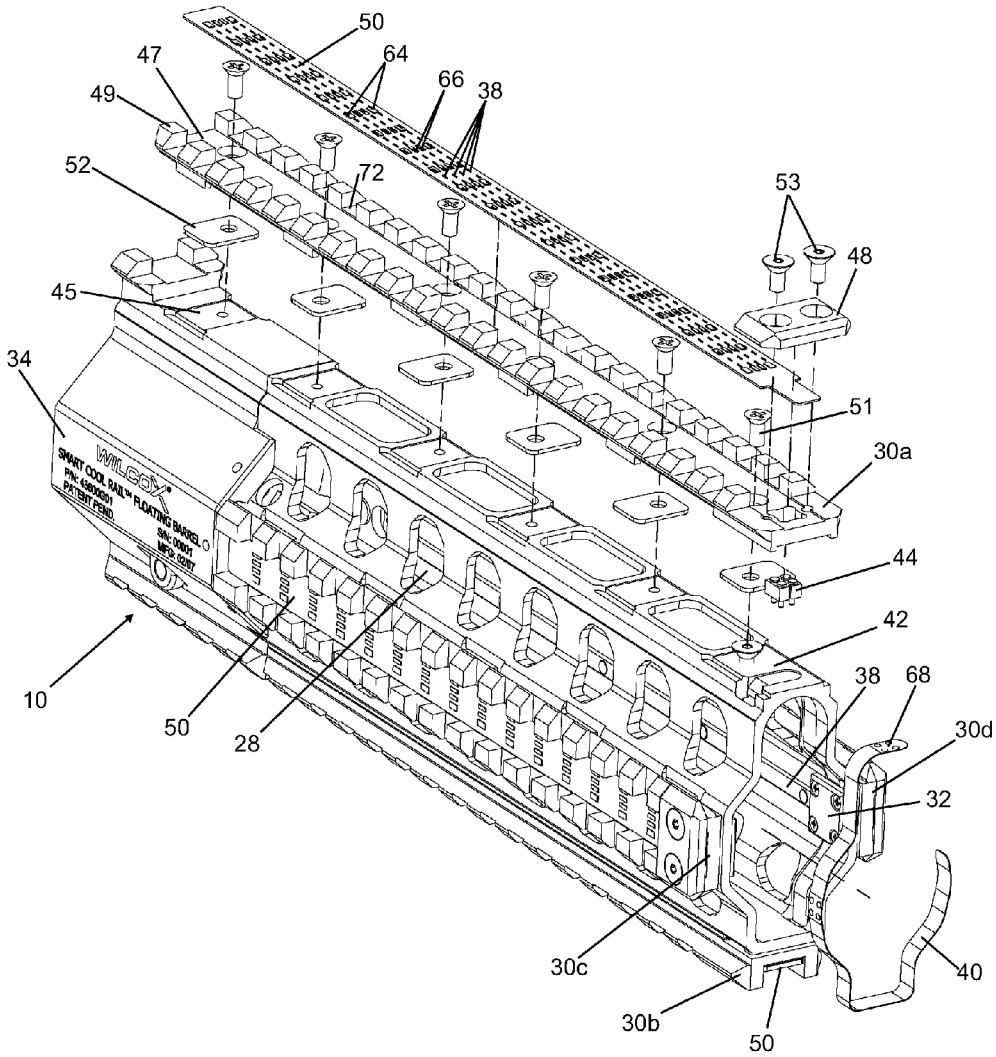
FIG. 5 is a partially exploded view of the floating rail system.
Figure 6:
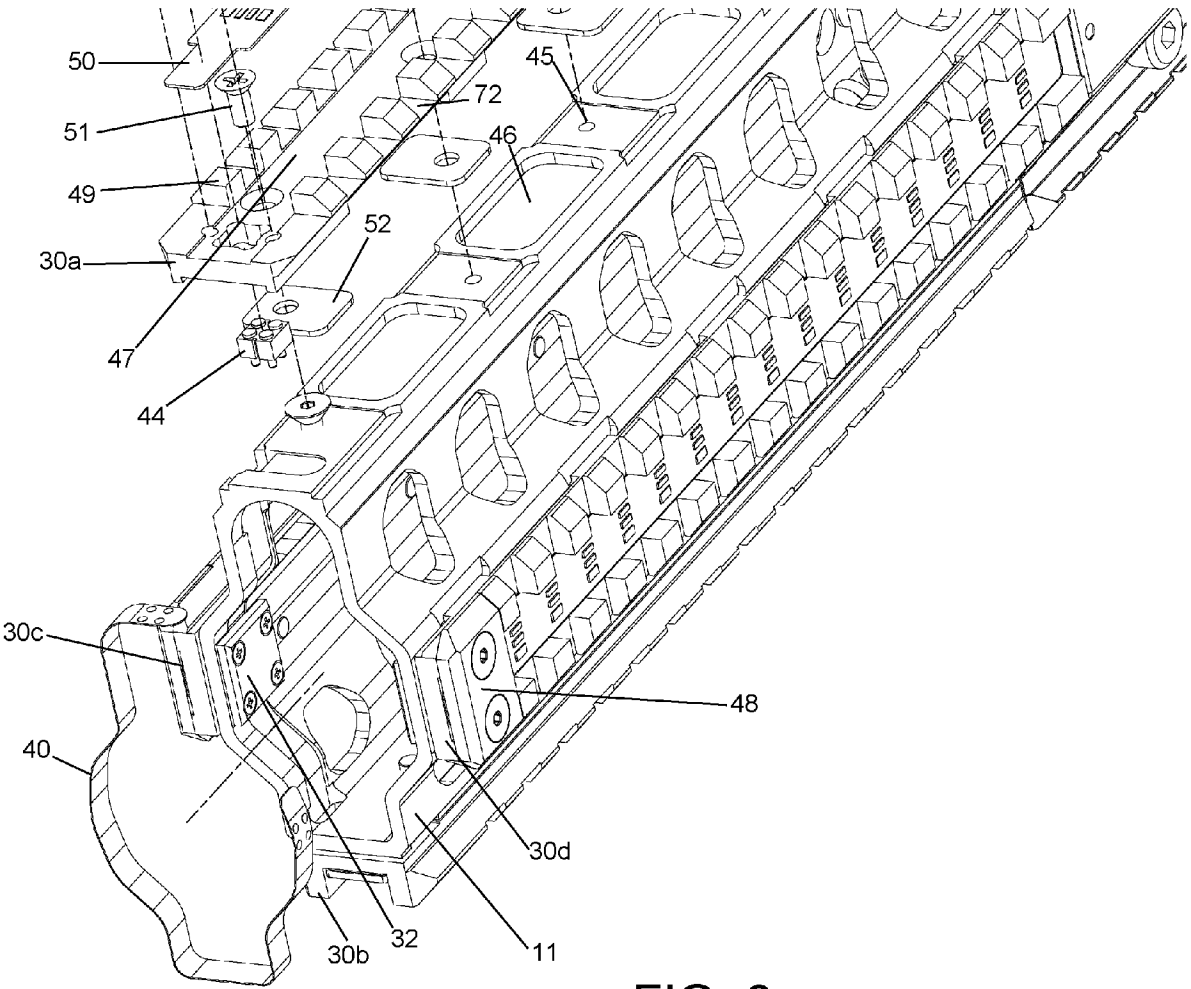
FIG. 6 is an enlarged, fragmentary, partially exploded view of the floating rail system depicted in FIG. 5.
Figure 7:
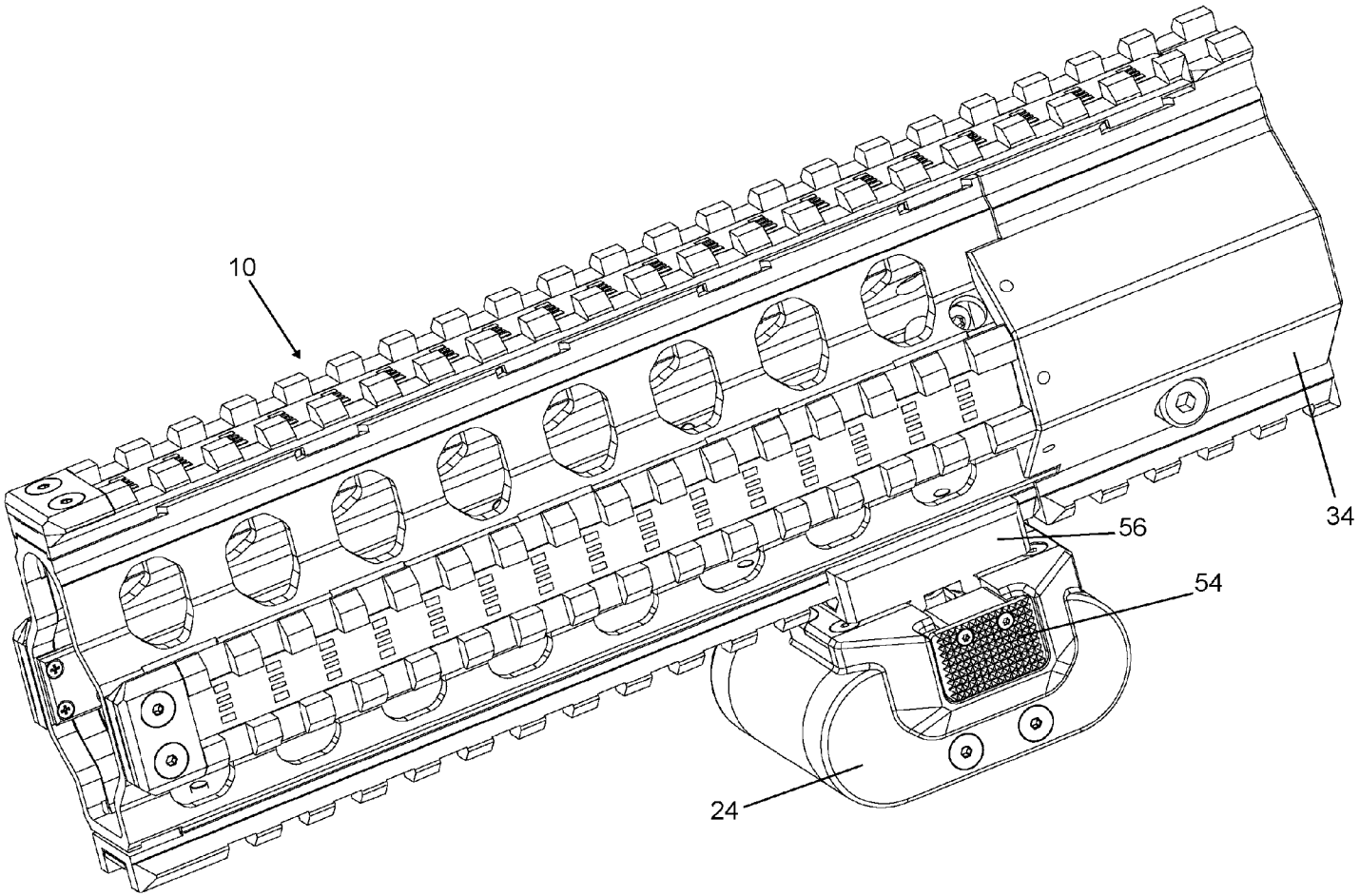
FIGS. 7 and 8 are side isometric views of the floating rail system with an attached power transfer module and power supply.
Figure 8:
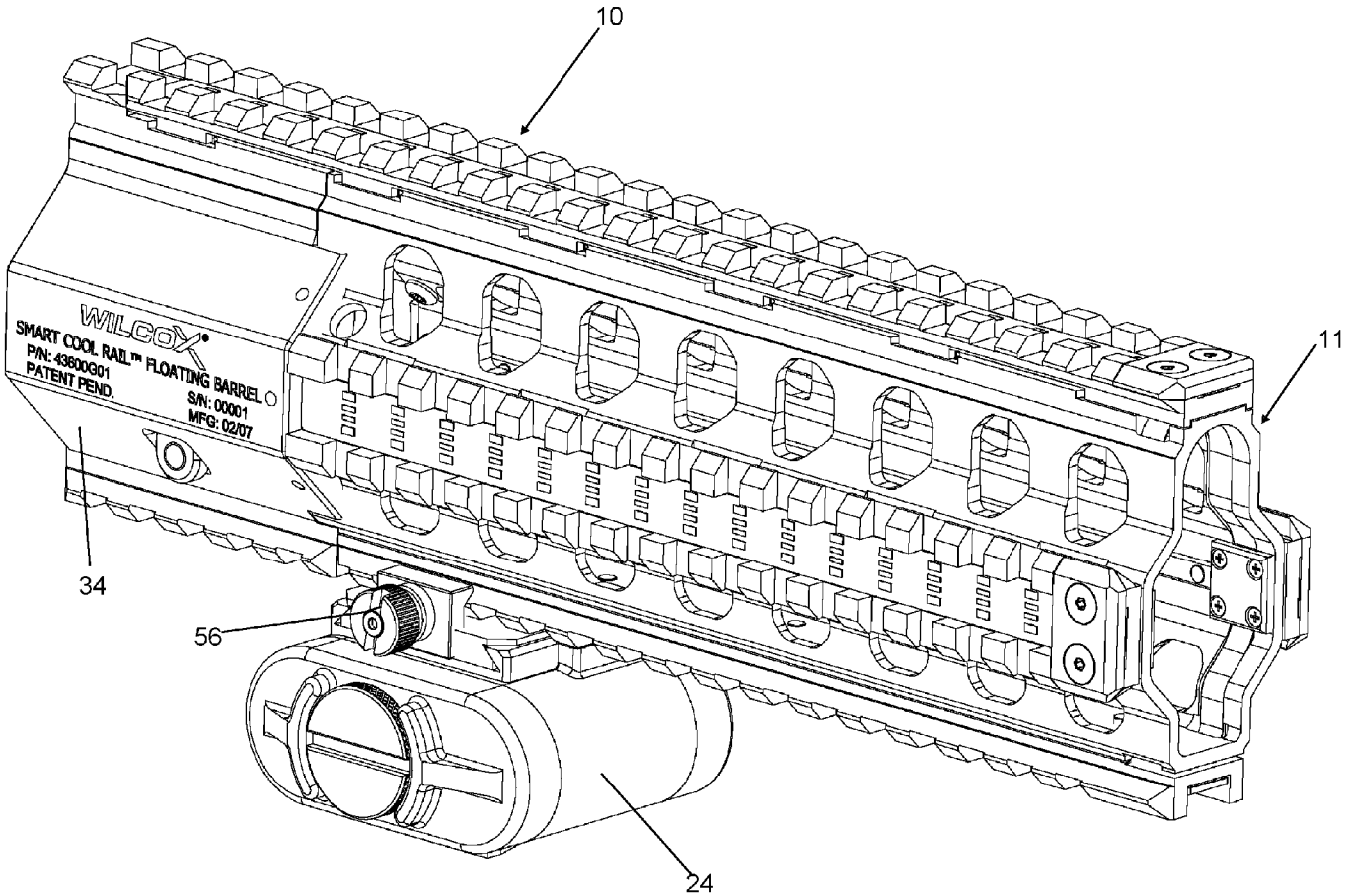
Figure 9:
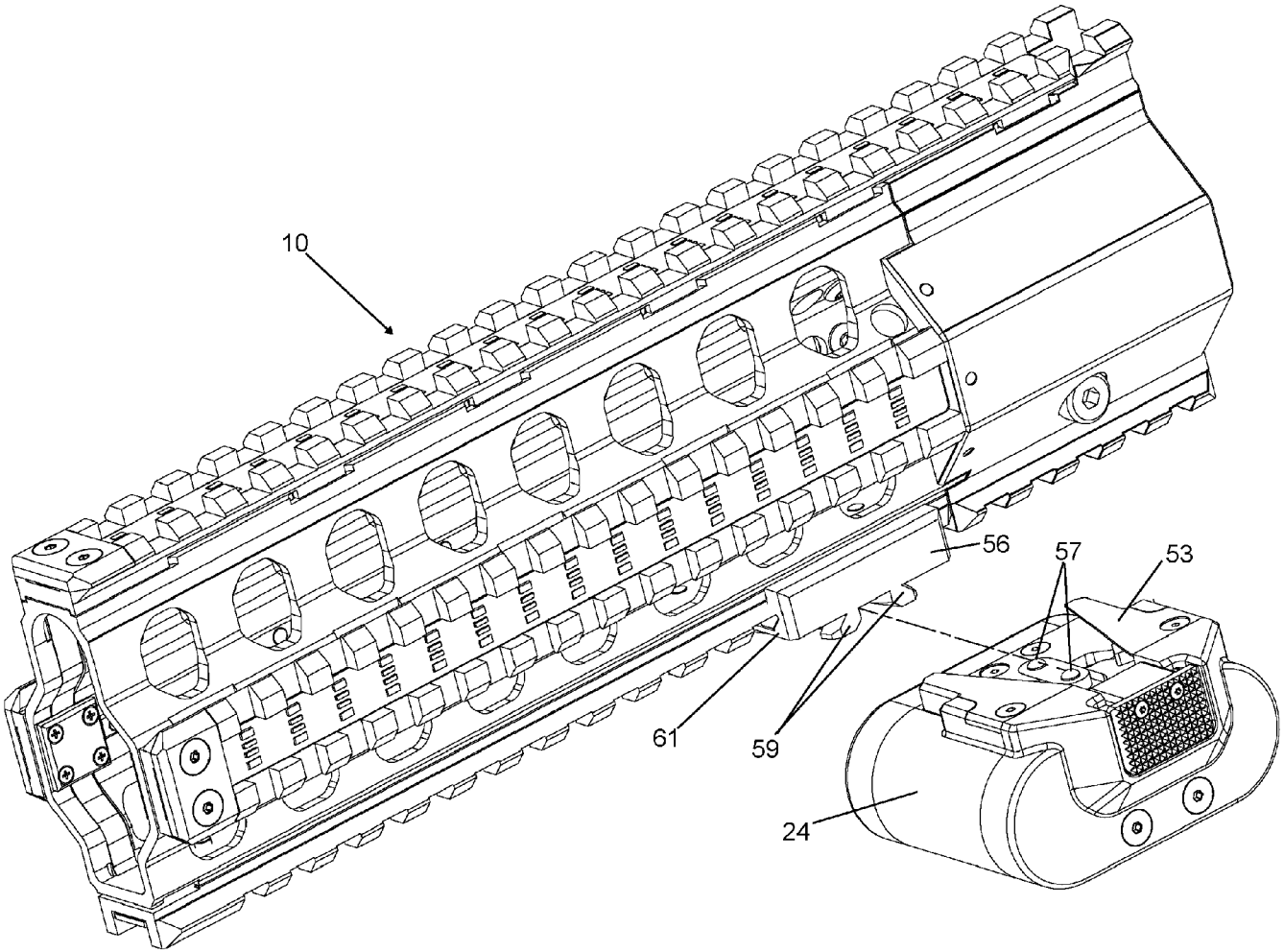
FIG. 9 is an isometric view of the floating rail system with the power supply released from the power transfer module.
Figure 10:
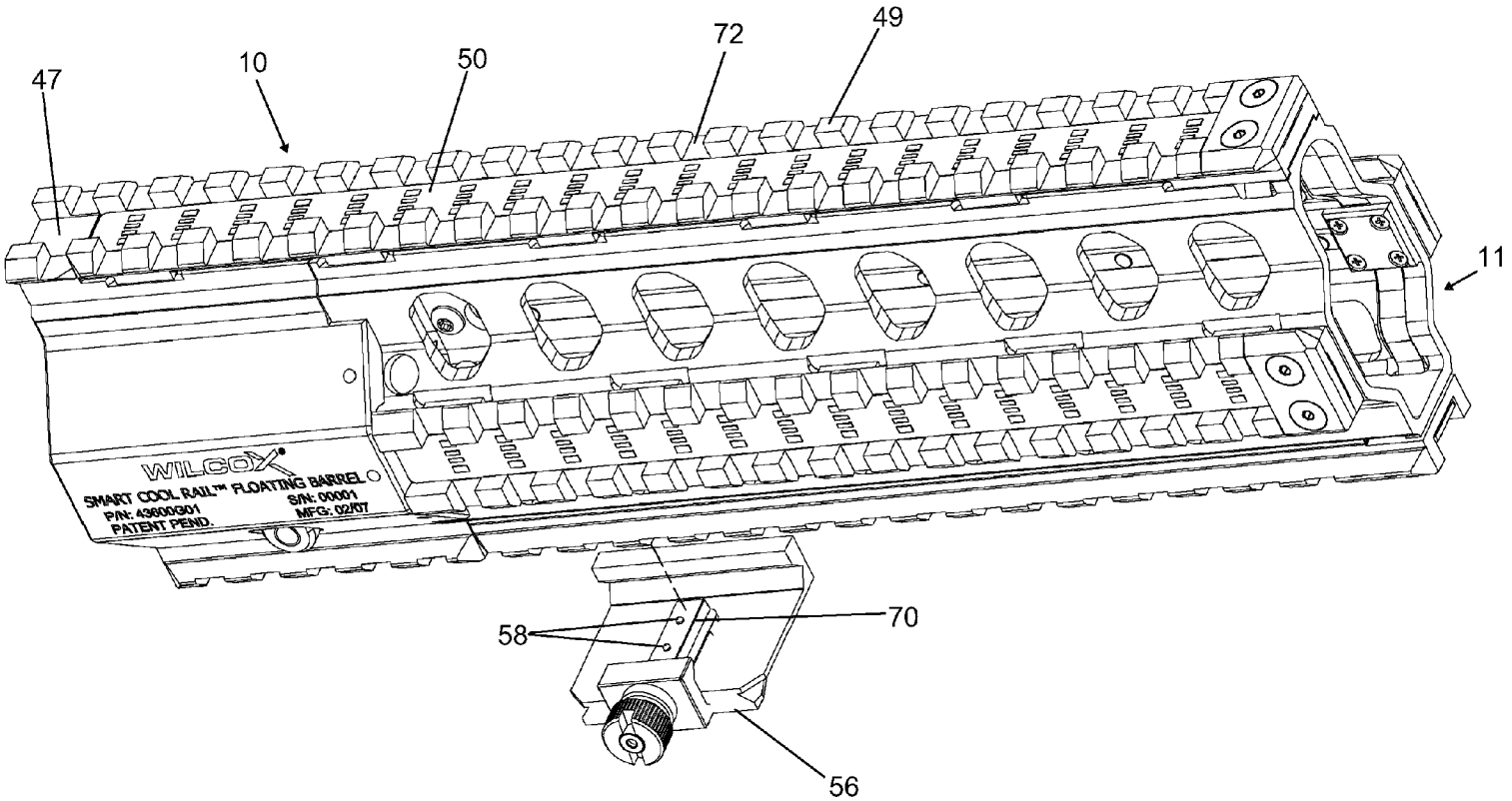
FIG. 10 is an isometric view of the floating rail system with an unattached power transfer module attachment.

Referring now to FIGS. 5 and 6 there is shown an exploded view of the floating rail system 10. The exterior surface of rail chassis 11 is connected to the interior surface of rear clamp 34. Chasses 11 has an interior t-shaped cavity where cables or wiring can be fed through without interfering with the barrel of firearm 12. Flex circuit 40 is attached to the interior surface of the cavity of chassis 11 and cooperates with transfer blocks 44 to connect the conductors 38 on each of the circuit boards 50 on the rails 30*a*, 30*b*, 30*c*, and 30*d* of the top, bottom, right, and left chassis portions 42, 60, 41, and 43, respectively, enabling accessory devices to transfer power and signals between each other.

Each of the top, bottom, right, and left chassis portions 42, 60, 41, and 43, respectively, of the floating rail system 10 contain a plurality of alternating longitudinally spaced transverse chassis channels 45 located along the firearm barrel axis. Recesses 46 are also located along the barrel axis of firearm 10, however they sit on chassis 11 in between each of the top, bottom, right, and left chassis portions 42, 60, 41, and 43, respectively. Rail insulators 52 formed of a thermally insulating material such as fiberglass can be inserted into chassis channels 45 between the top, bottom, right, and left chassis portions 42, 60, 41, and 43 and top, bottom, right and left modular rails 30*a*, 30*b*, 30*d*, and 30*c*, respectively, enabling them to reduce thermal transfer to the outer surface of the rails, thereby avoiding the need for hand guards. In addition the floating rail system 10 is helped to remain cool to the touch with additional cutouts 28 which are located on chassis 11. Rail insulators 52 and modular rails 30 are secured to the chassis 11 by threaded fasteners 51 or the like.

A circuit board 50 is secured into the longitudinal rail channel 47 created on the exterior of the modular rails 30 covering threaded fasteners 51. A plurality of mounting members 49 alternate with transversely-extending channels or grooves 39 in the Picatinny rail member 30. The alternating mounting members 49 and grooves create a mounting surface for all accessory devices. Anchor blocks 48 are secured with fasteners 53 to the modular rails 30 to secure the circuit board 50 into place. Once the circuit board 50 is secured in place it makes contact with the top of transfer contact block 44 having conductive vias extending through the contact block 44 to the bottom of contact block 44. Each conductive via makes contact with a corresponding conductor on a flex circuit 40. The flex circuit 40 is secured to the interior surface of the chassis 11 via blocks 32. Flex circuit 40 in turn provides the electrical connection between the circuit boards 50 in each of the Picattiny rails 30*a*, 30*b*, 30*c*, and 30*d* via associated contact blocks 44. The circuit board 50 thus provides an electrical power and signal coupling between attached devices and the power supply 24.

FIGS. 7-10 show the attachment of the power supply 24 to the floating rail system 10. Power supply 24 contains a quick release button 54 to enable the power supply to be quickly replaced when the power runs out. The power supply 24 is attached to floating rail system 10 via a power transfer module 56 which contains a mounting foot portion 59 and a rail grabber portion 61 for attachment to the Picattiny rails 30. In order to prevent axial movement of the attached accessory devices while the weapon is being fired protrusions, such as mounting foot protrusion 70, are added to mounting members to engage the transverse slots 72 created on Picattiny rails 30. The mounting foot 59 complements mounting shoe 53 of power supply 24 securely attaching the power supply 24 to the Picattiny rails 30 and forming an electrical connection between power supply 24 and the circuit board 50. Additional power supplies may be attached to power supply 24 via mounting shoe 25 located on the bottom of each power supply 24. Thereby allowing the operator to have a power supply with a longer life or enabling the operator to attach additional power supplies to power supply 24 when the battery is running low or has run out.

The power supply 24 can be attached at any desired position on the floating rail system 10 to give the user more versatility in positioning and arranging the accessory devices. Alternatively, the power supply 24 may be of a quick change, bayonet-mount type shown and described in U.S. patent application Ser. No. 11/591,886 filed Nov. 1, 2006, the entire contents of which are incorporated reference. The power supply 24 may include a mounting shoe 25 for attaching additional like power supplies 24 and to provide an electrical (e.g. parallel) connection thereto. Alternatively power supply units may be used with an electrical adaptor which may be attached to the Picattiny rails 30. The electrical adaptor enables the power supply to be located remotely and connected to the adaptor through an electrical cable. Remote power supplies may be located on the firearm 12, such as mounted in the buttstock portion of the firearm, or worn or carried by the weapons operator. Still other alternatives may enable the power supply to be located on the firearm 12, such as power supply 27 mounted in the firearms buttstock, and internally routed via conductors from the remote location to the floating 5 rail system, e.g., through the receiver portion of the firearm, thereby supplying any attached accessory devices with power.

Once attached power from the power supply 24 travels to the accessory devices via electrical shoe contacts 57 located on mounting shoe 53, which in turn transmit power through power module contacts 58 on mounting foot 59 of rail grabber 61 and to circuit board 50. The circuit board 50 contains four longitudinally-extending conductors 38 (shown in broken lines) which are sandwiched between non-conductive layers and have exposed contact pads 64 and 66. In the depicted embodiment the two exterior conductors may be power contact pads 64 and the two interior conductors may be signal contact pads 66. Each power contact pad 64 and each signal contact pad 66 connects to one via on the top of transfer contact block 44. The vias extend through to the bottom of transfer contact block 44 and connect to the corresponding contact pads 68 of flex circuit 40, which contains corresponding conductors thereon. Flex circuit 40 then transfers the power and signals to and from the other circuit boards 50 via like contact blocks 44.

Figure 11:
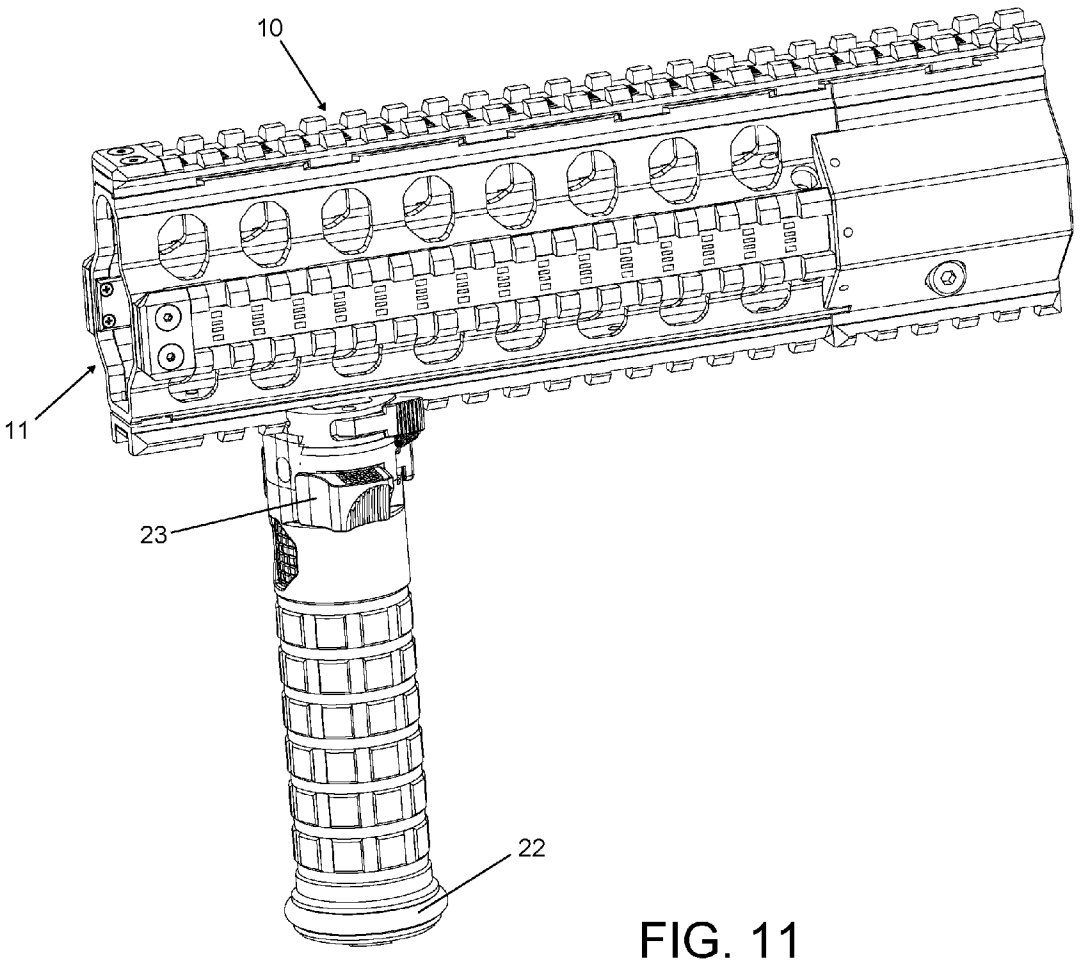
FIG. 11 is an isometric view of the floating rail system with a control grip.
Figure 12:
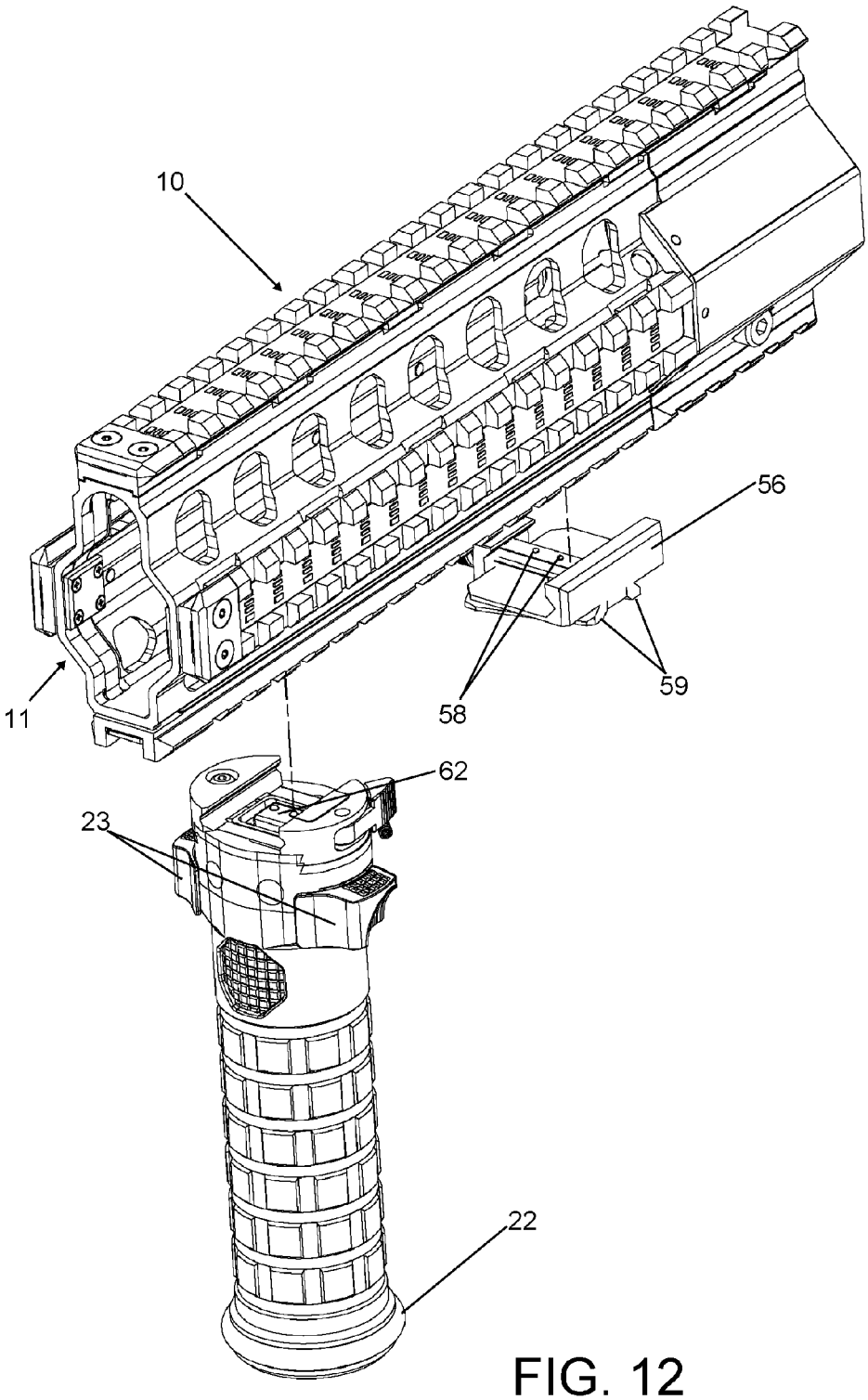
FIG. 12 is an isometric view with the floating rail system with a released control grip and control grip attachment.

FIGS. 11 and 12 show the attachment of handgrip unit 22 to the modular rails 30 located on bottom rail chassis 60. Once handgrip unit 22 attaches to modular rails 30 the handgrip contacts 62 engage the power contact pads 64 on the circuit board 50 enables power to reach handgrip 22. Likewise, signal terminals on the handgrip unit 22 may contact signal pads 66 on the circuit board 50 to allow signals to travel from handgrip 22 to the accessory device it is controlling. FIG. 12 also shows an alternate view of the power transfer module 56 and its contacts 58.

Figure 13B:
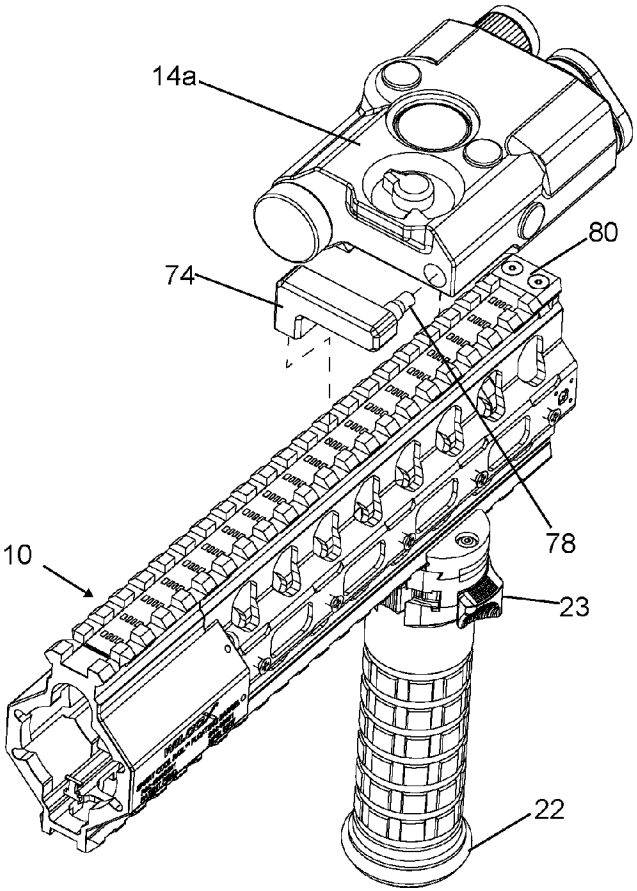
FIGS. 13*a* and 13*b* are isometric views of a further embodiment floating rail system incorporating a signal junction box showing the control signals transferred through the floating rail system to interface with accessory devices using standard control connectors.
Figure 13A:
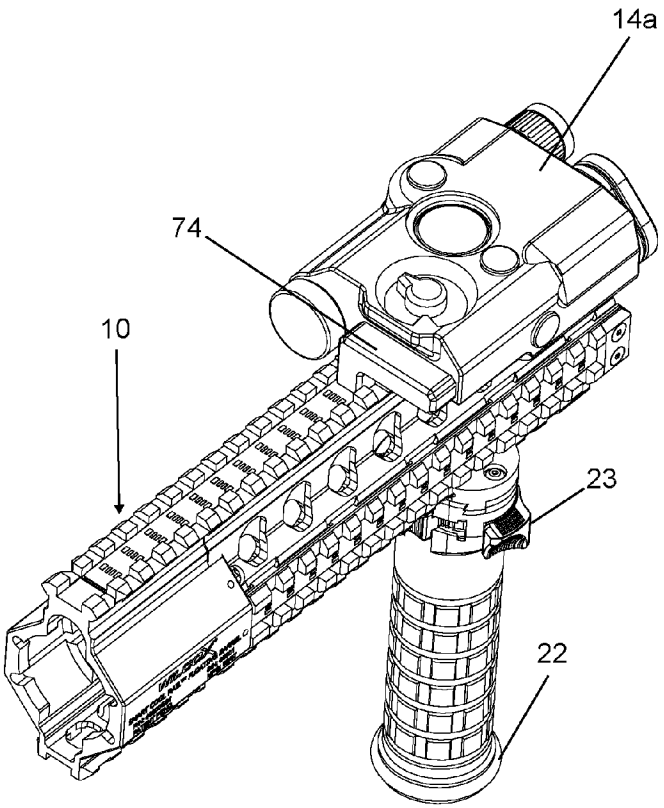

Referring now to FIGS. 13*a* and 13*b*, there is shown a signal adaptor 74 which enables off the shelf devices which lack the circuit board 50 attachment means to be used in conjunction with floating rail system 10. Signal adaptor 74 attaches to modular rails 30 and engages the signal contact pads 66 on circuit board 50 enabling signals to reach the off the shelf laser sight 14*a* via attachment of a plug 78 to signal input 80. In the depicted embodiment signal adaptor 74 is of a rigid form and easily connects to laser sight 14*a*, if signal input 80 is located in a different position on the laser sight 14*a*, then signal adaptor 74 may be made of a flexible wire allowing the operator to attach the laser sight 14*a*. Once laser sight 14*a* is attached to the Picatinny rails 30 signals may be transferred between the laser sight 14*a* and other devices, such as handgrip unit 22, allowing for handgrip unit 22 to control accessory device 76. Additional controllable accessory devices include laser designators, flash lights, communication devices, optical scopes, fire control systems, and other weapon mounted accessories. Any off the shelf accessory devices may be attached to the signal contact pads 66 of floating rail system 10 using signal adaptor 74.

The invention has been described with reference to the preferred embodiments. Modifications and alterations will occur to others upon a reading and understanding of the preceding disclosure herein, whereby it is to be distinctly understood that the foregoing descriptive matter is to be interpreted merely as illustrative of the invention and not as a limitation.

Having thus described the preferred embodiments, the invention is now claimed to be:

1. A floating rail system for mounting accessories on a firearm having a barrel, comprising:

a chassis;

a clamp attached to said chassis and adapted to attach the chassis about the barrel of the firearm;

a plurality of elongate accessory mounting rails attached to said chassis and extending parallel to an axis of the barrel, said accessory mounting rails supported on said chassis radially spaced apart from the barrel when the floating rail system is attached to the firearm; and a plurality of thermally insulating rail insulators disposed between said chassis and each of said accessory mounting rails.

2. The floating rail system of claim 1, wherein each of said mounting rails includes a Picatinny-type mounting structure.

3. The floating rail system of claim 1, further comprising:

said clamp attached to said chassis at a first, proximal end of said chassis; and a support block for attachment to the barrel to support a second, distal end of said chassis.

4. The floating rail system of claim 1, wherein there are four accessory mounting rails angularly spaced about the barrel.

5. The floating rail system of claim 1, further comprising:

each of said mounting rails attached to a corresponding attachment section of said chassis;

each attachment section having a plurality of longitudinally spaced apart transverse channels located along the barrel alternating with a plurality of longitudinally spaced apart transverse holes formed therein; and said rail insulators fitted into said transverse channels on said attachment section and covered by said mounting rails.

6. The floating rails system of claim 5, further comprising:

an air gap created between each of said attachment sections and each of said attached corresponding mounting rails.

7. The floating rail system of claim 6, further comprising:

said mounting rails having a plurality of axially spaced apart transverse grooves formed therein;

protrusions formed along the longitudinal channel alternating with the transverse grooves for engagement with attached accessory devices; and said mounting rails also having a centered longitudinal channel running parallel with the firearm barrel.

8. The floating rail system of claim 7, further comprising:

a circuit board secured in the longitudinal channel of each of said mounting rails;

each of said circuit boards carrying a plurality of axially-extending conductors, each conductor having a plurality of contact pads spaced along its length;

each conductor electrically coupled to a corresponding one said plurality of conductors on each of the other circuit boards; and said contact pads being positioned for contacting aligned electrical contacts on an accessory device attached to a one of said mounting rails.

9. The floating rail system of claim 8, further comprising:

each of said circuit boards having a first plurality of conductors for providing power from an electrically coupled power supply to an accessory device attached to any one of said mounting rails.

10. The floating rail system of claim 9, wherein the power supply is selected from a power supply mounted to any one of said mounting rails or a remote power supply electrically coupled to said mounting rails.

11. The floating rail system of claim 8, further comprising:

each of said circuit boards having a second plurality of conductors for transmitting an electrical control signal from a first accessory device attached to any one of said mounting rails to control operation of a second accessory device attached to any one of said mounting rails.

12. The floating rail system of claim 7, further comprising:

a flex circuit having conductive elements on a flexible circuit substrate in an interior defined by said chassis, said flex circuit providing an electrical connection between each conductor of a first one of said circuit boards and a corresponding conductor on each of the other circuit boards.

13. The floating rail system of claim 7, the floating rail system of claim 1, wherein there are four accessory mounting rails angularly spaced about the barrel.

14. The floating rail system of claim 11, further comprising:

a handgrip unit attached to one of said mounting rails and having signal contacts providing a connection between said contacts and said second plurality of conductors on one of said circuit boards; and said handgrip unit having one or more user-actuated switches thereon coupled to said signal contacts for transmitting a control signal for controlling operation of an accessory device attached to any of said mounting rails.

15. The floating rail system of claim 1, further comprising:

one or more electrical circuits disposed on said plurality of accessory mounting rails.

16. The floating rail system of claim 15, further comprising:

a plurality of electrical contacts on each of said plurality of accessory mounting rails, said plurality of electrical contacts electrically coupled to said electrical circuit; and a power supply electrically coupled to at least one of said one or more electrical circuits.

17. The floating rail system of claim 16, further comprising:

said power supply removably attachable to a selected one of said mounting rails;

said power supply including electrical contacts which are aligned and contacting with selected ones of said plurality of electrical contacts on said plurality of accessory mounting rails when the power supply is attached said selected one of said mounting rails; and said one or more electrical circuits providing an electrical coupling between said power supply and additional ones of said plurality of electrical contacts on said plurality of accessory mounting rails.

18. The floating rail system of claim 17, wherein said power supply includes a quick connect and disconnect fastener for removably securing the power supply to the selected one of said mounting rails.

19. The floating rail system of claim 16, wherein said power supply is located remotely from said plurality of mounting rails.

20. A floating rail system for mounting accessories on an associated firearm having a barrel, comprising:

a chassis;

a clamp attached to said chassis and adapted to attach the chassis about the barrel of the associated firearm;

a plurality of elongate accessory mounting rails attached to said chassis and extending parallel to an axis of the barrel, said accessory mounting rails supported on said chassis radially spaced apart from the barrel when the floating rail system is attached to the associated firearm;

one or more electrical circuit disposed on said plurality of accessory mounting rails;

a plurality of electrical contacts on each of said plurality of accessory mounting rails, said plurality of electrical contacts electrically coupled to said electrical circuit; and a power supply electrically coupled to at least one of said one or more electrical circuits, wherein said power supply is located in a buttstock portion of the associated firearm when said floating rail system is attached to the associated firearm.

* * * * *